US008306457B2

(12) United States Patent
Saiki et al.

(10) Patent No.: US 8,306,457 B2
(45) Date of Patent: Nov. 6, 2012

(54) UNIT AND IMAGE FORMING APPARATUS INCLUDING THE SAME

(75) Inventors: Mikio Saiki, Saitama (JP); Hiroko Furukata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1167 days.

(21) Appl. No.: 11/949,858

(22) Filed: Dec. 4, 2007

(65) Prior Publication Data

US 2008/0219700 A1 Sep. 11, 2008

(30) Foreign Application Priority Data

Mar. 5, 2007 (JP) ..... 2007-054754

(51) Int. Cl.
*G03G 15/16* (2006.01)

(52) U.S. Cl. ..... 399/122

(58) Field of Classification Search ..... 399/111–116, 399/119, 120, 122, 123, 125
See application file for complete search history.

(56) References Cited

U.S. PATENT DOCUMENTS

| | | | | | |
|---|---|---|---|---|---|
| 4,912,563 | A * | 3/1990 | Narita | 358/401 |
| 5,583,612 | A * | 12/1996 | Schell et al. | 399/107 |
| 5,732,620 | A * | 3/1998 | Christy et al. | 100/80 |
| 5,769,517 | A * | 6/1998 | Carde | 312/333 |
| 5,794,103 | A * | 8/1998 | Oh | 399/119 |
| 6,285,846 | B1 * | 9/2001 | Suzuki et al. | 399/122 |
| 6,527,353 | B1 * | 3/2003 | Bradfish et al. | 312/332.1 |
| 6,961,528 | B2 * | 11/2005 | Yamaguchi et al. | 399/119 |
| 6,997,527 | B2 * | 2/2006 | Cheng | 312/332.1 |

FOREIGN PATENT DOCUMENTS

| | | | |
|---|---|---|---|
| JP | 04350685 | A | 12/1992 |
| JP | 07295381 | A | 11/1995 |
| JP | 8-30060 | A | 2/1996 |
| JP | 10048984 | A * | 2/1998 |
| JP | 11-109830 | A | 4/1999 |
| JP | 2003-241615 | A | 8/2003 |

OTHER PUBLICATIONS

Machine Translation of JP 10048984 A obtained on Sep. 10, 2010.*
Japanese Office Action issued on Oct. 18, 2011 in the corresponding Japanese Patent Application No. 2007-054754.
Japanese Office Action dated Apr. 17, 2012 issued by the Japanese Patent Office in counterpart Japanese Application No. 2007-054754.

* cited by examiner

*Primary Examiner* — David Gray
*Assistant Examiner* — Gregory H Curran
(74) *Attorney, Agent, or Firm* — Sughrue Mion, PLLC

(57) ABSTRACT

A unit, which is configured to be attachable to and detachable from a body of an apparatus, includes: a holding portion for holding the unit to attach and detach the unit to and from the apparatus body, the holding portion being projected from a housing of the unit; and a lock mechanism for fixing the unit to the apparatus body, wherein an operating portion of the lock mechanism is operated to retract inside a projection end portion of the holding portion, by an operation of moving the lock mechanism to a lock cancel position.

16 Claims, 18 Drawing Sheets

(a)

(b)

UNIT AND IMAGE FORMING APPARATUS INCLUDING THE SAME

CROSS-REFERENCE TO RELATED APPLICATIONS

This application is based on and claims priority under 35 USC 119 from Japanese Patent Application No. 2007-54754 filed on Mar. 5, 2007.

BACKGROUND

1. Technical Field

The present invention relates to a unit and an image forming apparatus including it.

2. Related Art

Conventionally, in an image forming apparatus employing, for example, the electrophotographic system such as a copier, a printer, or a facsimile apparatus, in order to comply with a request for improving the operability or the maintainability, various functional members are unitized so as to constitute one unit, and the unit is replaced with another unit as required. An example of such a unit is a fixing device. An image forming apparatus using such a fixing device is configured so that a toner image which is formed in accordance with image information is transferred onto a transfer sheet, and the transfer sheet onto which the unfixed toner image is transferred is heated and pressed by the thermal fixing device to apply a fixing process, thereby fixing the unfixed toner image onto the transfer sheet to obtain a permanent image.

The fixing device is configured so as to be attachable to and detachable from the apparatus body for the purpose that, in the case where the life of the fixing device is shorter than that of the image forming apparatus, the fixing device is used as a component needing periodic replacement, and, in the case of a fault, maintenance such as replacement is performed.

In such an image forming apparatus, recently, miniaturization and reduction in weight are advancing, and, in accordance with this, also a unit is further miniaturized and reduced in weight. Therefore, a mechanism for enabling the unit to be attached to and detached from the body of the image forming apparatus is requested to attain excellent operability in addition to miniaturization and the like.

In the conventional unit, in accordance with miniaturization and weight reduction, however, an operating portion of the lock mechanism for enabling the unit to be attached to and detached from the image forming apparatus body must be made small. When the unit is to be attached to or detached from the image forming apparatus body, therefore, the user must operate the unit in the following manner. The operating portion of the lock mechanism is operated to cancel the lock mechanism. In a state where the hand is once separated from the operating portion of the lock mechanism, thereafter, another portion of the unit is held by the hand, and then the unit is attached to or detached from the image forming apparatus body. Consequently, the operability is inevitably lowered.

SUMMARY

According to an aspect of the invention, there is provided a unit which is configured to be attachable to and detachable from a body of an apparatus, wherein the unit has: a holding portion for holding the unit to attach and detach the unit to and from the apparatus body, the holding portion being projected from a housing of the unit; and a lock mechanism for fixing the unit to the apparatus body, and an operating portion of the lock mechanism is operated to retract inside a projection end portion of the holding portion, by an operation of moving the lock mechanism to a lock cancel position.

BRIEF DESCRIPTION OF THE DRAWINGS

Exemplary embodiment(s) of the present invention will be described in detail based on the following figures, wherein.

DETAILED DESCRIPTION

Hereinafter, embodiments of the invention will be described with reference to the drawings.

Embodiment 1

Figure 2:
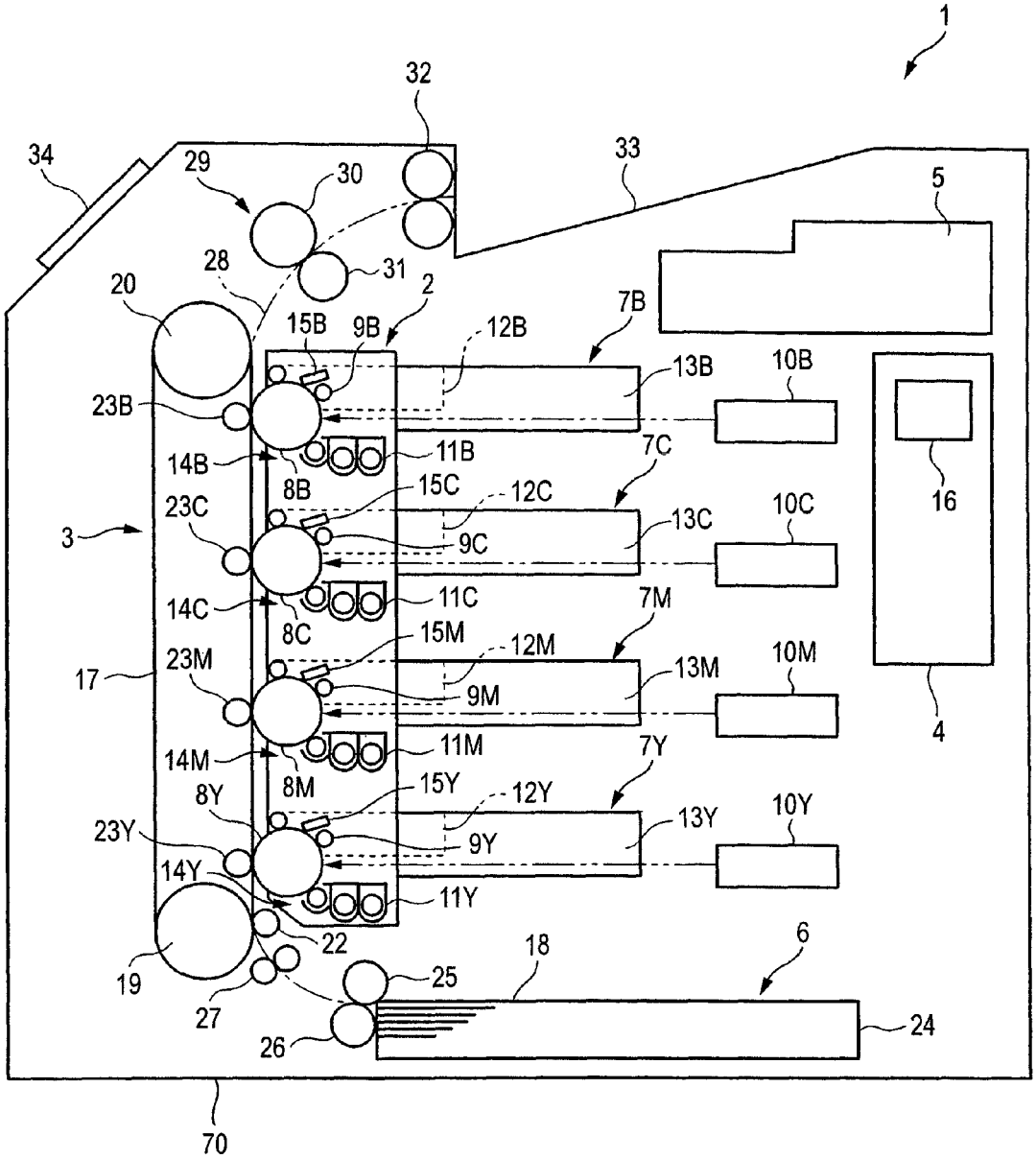
FIG. 2 is a diagram showing a tandem full-color printer that is an image forming apparatus to which the fixing device of Embodiment 1 of the invention is applied.

FIG. 2 shows an image forming apparatus, i.e., a tandem full-color printer to which a fixing device that is a unit of Embodiment 1 of the invention is applied. The full-color printer is configured so as to execute a printing operation on the basis of image data sent from a personal computer, a scanner, or the like. It is a matter of course that the image forming apparatus may be configured as a copier or facsimile apparatus having a scanner, a multifunction machine having the functions of these apparatuses, or the like.

In FIG. 2, 1 denotes the body of the tandem full-color printer. In the full-color printer body 1, an image forming unit 2 is placed so as to vertically extend in a substantially middle portion of the body. In the full-color printer body 1, also, a sheet conveyor belt unit 3 for conveying a transfer member onto which a plural-color toner image formed by the image forming unit 2 is to be transferred in a sucked state is placed on one side (in the illustrated example, the left side) of the image forming unit 2. A controlling unit 4 comprising a control circuit and the like is placed on the other side (in the illustrated example, the right side) of the image forming unit 2, and a power source circuit unit 5 comprising a high-voltage power source circuit and the like is placed obliquely above the image forming unit 2. A sheet feeding device 6 which feeds a transfer sheet 18 serving as a transfer member is placed in a bottom portion of the full-color printer body 1.

In the image forming unit 2, four image forming portions 7Y, 7M, 7C, 7B which respectively form toner images of colors of yellow (Y), magenta (M), cyan (C), and black (B) are sequentially arranged from the lower side. The four image forming portions 7Y, 7M, 7C, 7B are vertically arranged in a series manner at constant intervals.

The four image forming portions 7Y, 7M, 7C, 7B are formed in the same manner except the color of a formed image, and, as shown in FIG. 2, generally configured by: a photosensitive drum 8 which is rotated at a predetermined rotational speed; a charging roll 9 for primary charging which uniformly charges the surface of the photosensitive drum 8: an ROS (Raster Output Scanner) which exposes the surface of the photosensitive drum 8 with an image corresponding to the color, to form an electrostatic latent image; a developing device 11 which develops the electrostatic latent image formed on the photosensitive drum 8, with a toner of the corresponding color; a cleaning device 12 which removes away the post-transfer residual toner remaining on the photosensitive drum 8; and a toner cartridge 13 which supplies the toner to the developing device 11.

As shown in FIG. 2, the developing device 11 is configured so as to supply a two- or one-component developer housed in the device to a developing roll 14 while stirring the developer, convey the developer supplied to the developing roll 14 to a developing region opposed to the photosensitive drum 8, while restricting the thickness of the developer, and develop the electrostatic latent image formed in the surface of the photosensitive drum 8, with a toner of a predetermined color.

As shown in FIG. 2, the cleaning device 12 is configured so that the post-transfer residual toner remaining on the surface of the photosensitive drum 8 is removed away by a cleaning blade 15, and the removed post-transfer residual toner is conveyed into the cleaning device 12 to be housed therein.

In the full-color printer body 1, as shown in FIG. 2, the controlling unit 4 is disposed. For example, an image processing system (IPS) 16 which applies a predetermined image process on the image data is disposed in the controlling unit 4. The image processing system 16 sequentially outputs image data of yellow (Y), magenta (M), cyan (C), and black (B) to the ROS 10. Four laser beams LB emitted from the ROS 10 in accordance with the image data scan and expose over the respective photosensitive drums 8Y, 8M, 8C, 8B, thereby forming electrostatic latent images. The electrostatic latent images formed on the respective photosensitive drums 8Y, 8M, 8C, 8B are developed by the developing devices 11Y, 11M, 11C, 11B as toner images of the colors of yellow (Y), magenta (M), cyan (C), and black (B), respectively.

As shown in FIG. 2, the sheet conveyor belt unit 3 comprises a sheet conveyor belt 17 which is an endless belt, and which circulates or moves in an endless manner. The sheet conveyor belt 17 is configured so as to convey the transfer sheet 18 serving as a transfer member onto which the toner images of the colors of yellow (Y), magenta (M), cyan (C), and black (B) formed by the image forming portions 7Y, 7M, 7C, 7B are to be transferred, in an electrostatically sucked state.

As shown in FIG. 2, the sheet conveyor belt 17 is stretched at a predetermined tension around a driving roll 19 and driven roll 20 which are stretch rolls that are vertically arranged. The sheet conveyor belt is caused by the driving roll 19 which is rotary driven by a driving motor (not shown), to circulatingly move at a predetermined speed in a counterclockwise direction.

The distance between the driving roll 19 and the driven roll 20 is set to a length which is substantially equal to the length of the transfer sheet 18 of A3 size. It is a matter of course that the distance between the driving roll 19 and the driven roll 20 is not restricted to this and may be set to an arbitrary value. As the sheet conveyor belt 17, for example, a belt in which a film of a flexible synthetic resin such as polyimide is formed into an endless belt is used.

As shown in FIG. 2, a suction roll 22 for causing the transfer sheet 18 to be electrostatically sucked to the surface of the sheet conveyor belt 17 is disposed so as to butt against the surface of the driving roll 19 via the sheet conveyor belt 17. In the same manner as the charging rolls 9 of the image forming portions 7Y, 7M, 7C, 7B, for example, the suction roll 22 is configured by covering the surface of a metal core member with conductive rubber. A predetermined suction bias voltage is applied to the metal core member. The suction roll 22 electrostatically charges the transfer sheet 18 sent from the sheet feeding device 6, thereby causing the sheet to be sucked to the surface of the sheet conveyor belt 17. The suction roll 22 is not always necessary.

The toner images of colors of yellow (Y), magenta (M), cyan (C), and black (B) formed on the photosensitive drums 8Y, 8M, 8C, 8B of the image forming portions 7Y, 7M, 7C, 7B are multiply transferred in an overlapping manner by transfer rolls 23Y, 23M, 23C, 23B onto the transfer sheet 18 which is conveyed in a state where it is sucked to the surface of the sheet conveyor belt 17 as shown in FIG. 2. The transfer rolls 23Y, 23M, 23C, 23B are integrally attached to the sheet conveyor belt unit 3.

As shown in FIG. 2, the transfer sheet 18 is fed from the sheet feeding device 6 which is disposed in the bottom portion of the printer body 1. The sheet feeding device 6 comprises a sheet tray 24 which houses the transfer sheet 18 of a desired size and material. From the sheet tray 24, the transfer sheet 18 of the desired size and material is fed by a feeding roll 25 in a state where each sheet is separated by a separating roll 26, and conveyed to a suction position on the sheet conveyor belt 17 at a predetermined timing via registration rolls 27 serving as sheet feeding unit.

As the transfer sheet 18, sheet-like members of various sizes such as A4, A3, B5, and B4 sizes, and various materials such as thick paper of plain paper, coated paper, or the like, or OHP sheets may be used.

As shown in FIG. 2, the transfer sheet 18 onto which the toner images of colors of yellow (Y), magenta (M), cyan (C), and black (B) are multiply transferred is separated from the sheet conveyor belt 17 by the rigidity (so-called stiffness) of the transfer sheet 18 itself, and then conveyed to a fixing device 29 along a conveying path 28. The color toner images are fixed onto the transfer sheet 18 by the heat and pressure of the fixing device 29. The sheet conveyor belt 17 and the fixing device 29 are disposed close to each other, so that the transfer sheet 18 separated from the sheet conveyor belt 17 is conveyed to the fixing device 29 by the conveying force of the sheet conveyor belt 17. The fixing device 29 is configured so that a heating roll 30 and a pressure belt 31 are rotated in a state where they are pressingly contacted with each other, and the transfer sheet 18 is passed through a nip portion formed between the heating roll 30 and the pressure belt 31, thereby applying a fixing process by means of heat and a pressure. Thereafter, the transfer sheet 18 onto which the color toner images are fixed is discharged by discharge rolls 32 in a state where the printed surface is downward directed, onto a discharge tray 33 disposed in an upper portion of the full-color printer body 1, thereby ending the printing operation.

In the full-color printer, not only a full-color image, but also an image of a desired color, such as a monochrome image can be printed. In accordance with the color of an image to be printed, a toner image(s) are formed by the image forming portions 7Y, 7M, 7C, 7B for all or a part of yellow (Y), magenta (M), cyan (C), and black (B).

In FIG. 2, 34 denotes an operation panel comprising a display portion such as a liquid crystal panel attached to the front face of the printer body 1. The operation panel 34 is configured so as to display the status of the printer or allow a necessary operation or the like to be performed.

The embodiment has a configuration where the unit is configured to be attachable to and detachable from the apparatus body, the unit has: a holding portion for holding the unit to attach and detach the unit to and from the apparatus body, the holding portion being projected from a housing of the unit; and a lock mechanism for fixing the unit to the apparatus body, and an operating portion of the lock mechanism is operated to retract inside a projection end portion of the holding portion, by an operation of moving the lock mechanism to a lock cancel position.

In the embodiment, namely, the fixing device 29 and the discharge rolls 32 are integrated with each other to be configured as a unit as shown in FIG. 2, so that the fixing device 29 is attachable to and detachable from the full-color printer body 1.

Figure 3:
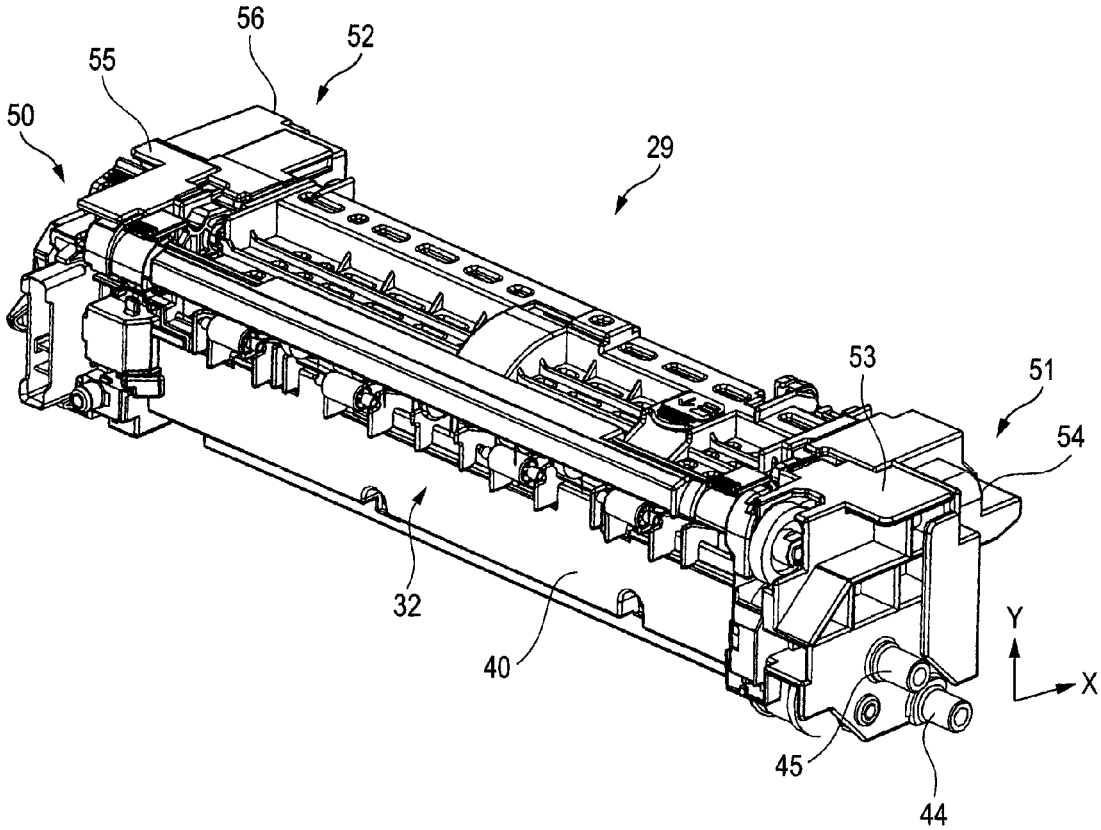
FIG. 3 is an external perspective view showing the fixing device of Embodiment 1 of the invention.
Figure 5:
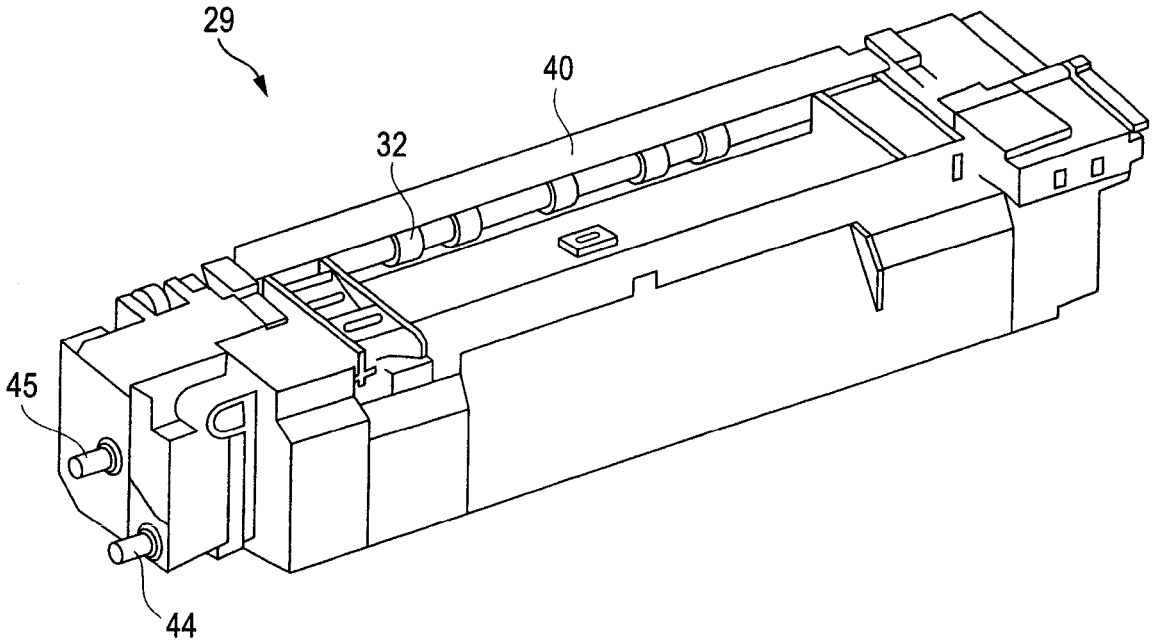
FIG. 5 is an external perspective view showing the fixing device of Embodiment 1 of the invention.
Figure 6:
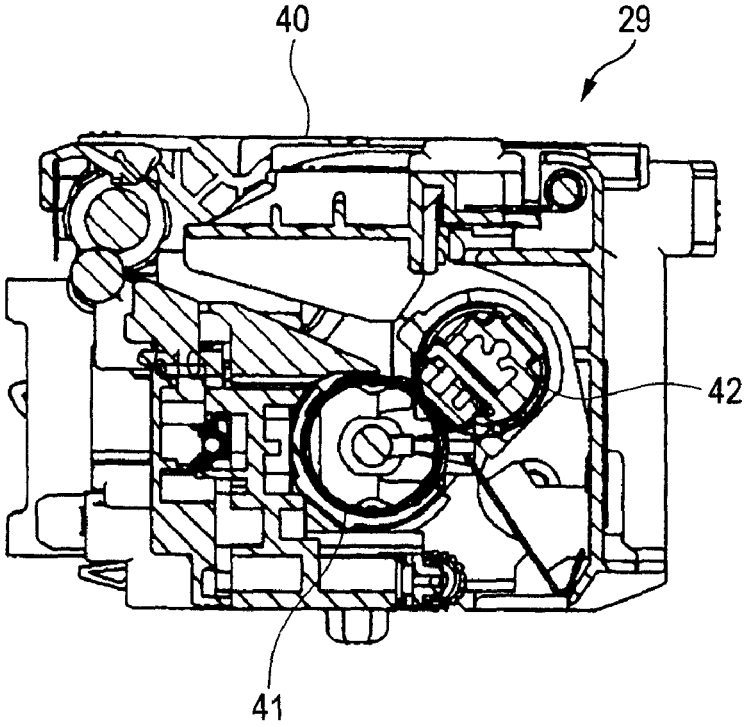
FIG. 6 is a section diagram showing the fixing device of Embodiment 1 of the invention.

As shown in FIGS. 3 and 5, the fixing device 29 and the discharge rolls 32 are integrally formed into a substantially rectangular parallelepiped box-like shape. As shown in FIG. 6, a heating roll 41 in which a heat source is disposed, and a pressure belt 42 which is rotated in a state where it is pressingly contacted with the heating roll 41 are disposed in a housing 40 of the fixing device 29. The transfer sheet 18 onto which an unfixed toner image is transferred is passed through a nip portion 43 between the heating roll 41 and the pressure belt 42, whereby the unfixed toner image is fixed onto the transfer sheet 18 by means of heat and a pressure to obtain a permanent image. The transfer sheet 18 which has been passed through the nip portion 43 between the heating roll 41 and the pressure belt 42 is discharged by the discharge rolls 32 in a state where the printed surface is downward directed, onto the discharge tray 33 disposed in an upper portion of the full-color printer body 1 as shown in FIG. 2.

Figure 4:
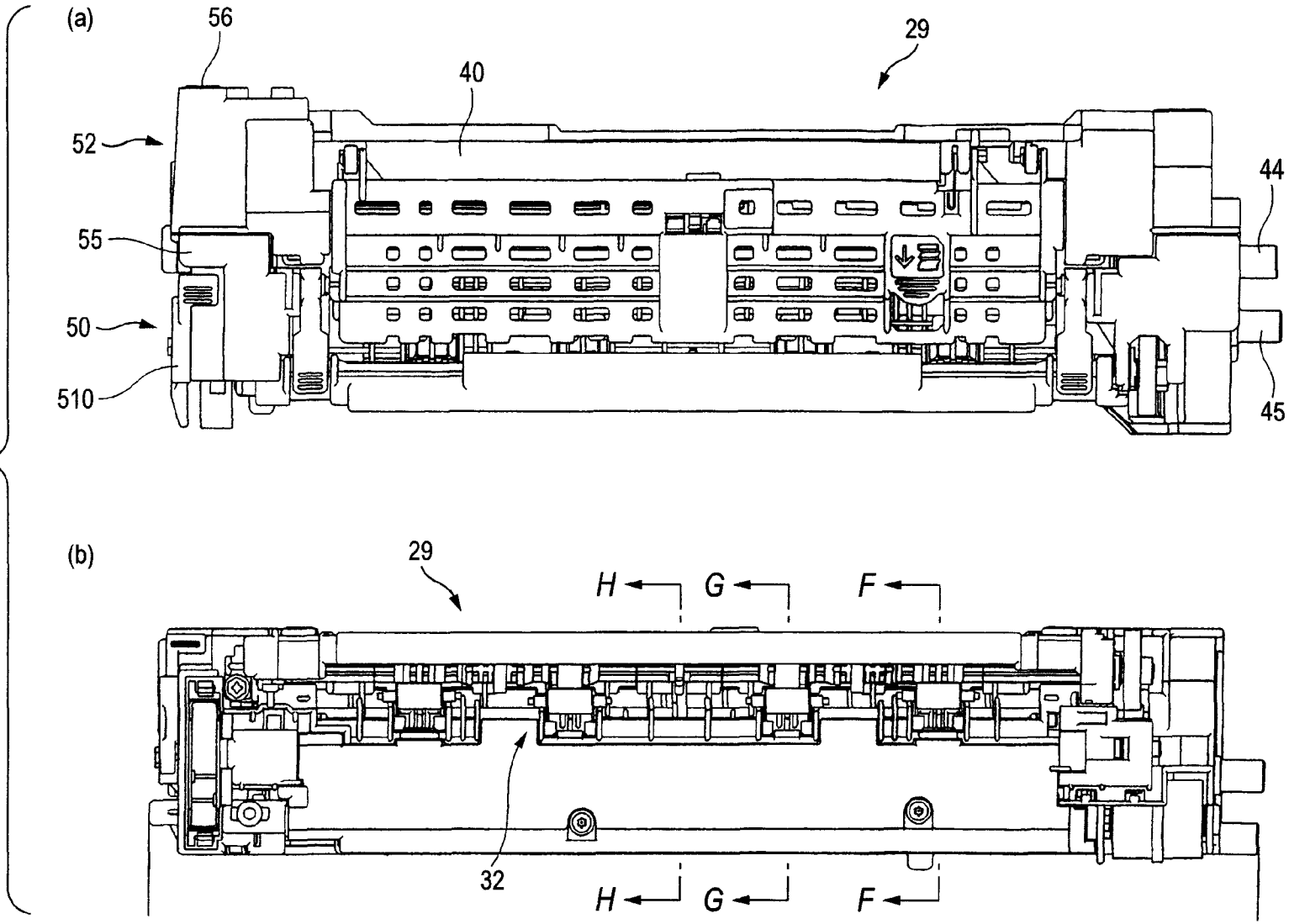
FIG. 4 illustrates plan and front views showing the fixing device of Embodiment 1 of the invention.
Figure 7:
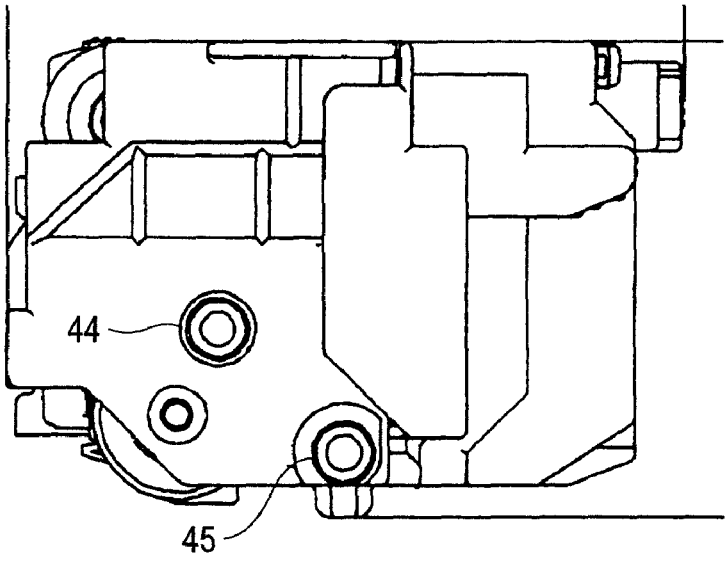
FIG. 7 is a side view showing the fixing device of Embodiment 1 of the invention.

As shown in FIGS. 3, 4, and 7, a first rod 44 which, when the fixing device 29 is attached to the full-color printer body 1, restricts the X- and Y-direction positions of the fixing device 29, and a second rod 45 which restricts only the Y-direction position of the fixing device 29 are disposed on one side face of the fixing device 29. The X-direction indicates a horizontal direction, and the Y-direction indicates a vertical direction.

Figure 8:
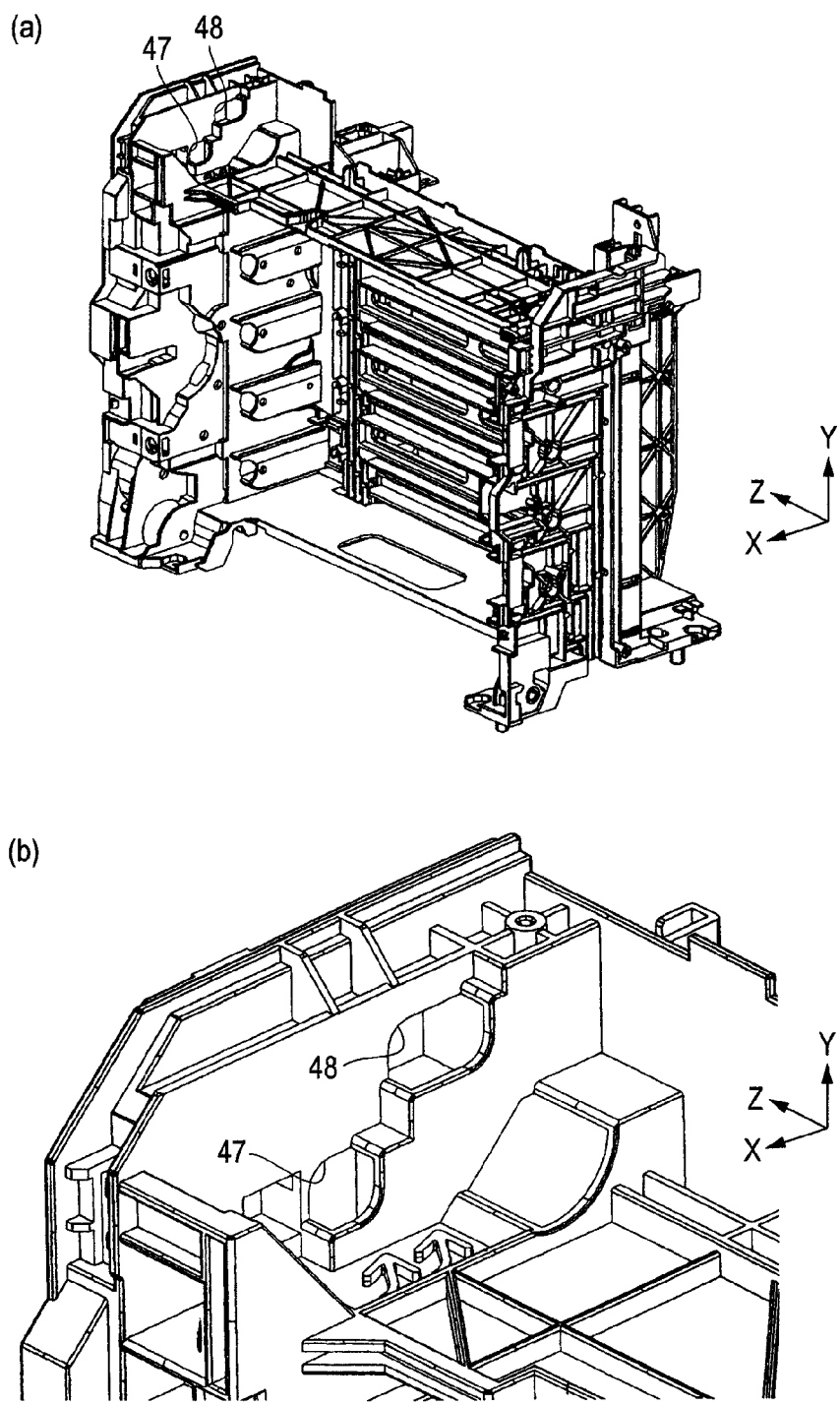
FIG. 8 is a side view of a frame showing a tandem full-color printer that is an image forming apparatus to which the fixing device of Embodiment 1 of the invention is applied.

When the fixing device 29 is to be attached to the full-color printer body 1, as shown in FIG. 8, the first rod 44 is fitted into a first positioning hole 47 disposed in a frame 46 of the printer body 1, and the second rod 45 is fitted into a second positioning hole 48 disposed in the frame 46 of the printer body 1, whereby one end portion of the fixing device 29 is positioned and fixed. The driving of the apparatus body is transmitted to the side of the one end portion of the fixing device 29.

As shown in FIG. 3, a lock mechanism 50 for fixing the fixing device 29 to a predetermined position of the full-color printer body 1 is disposed on the other side face of the fixing device 29.

As shown in FIGS. 3 and 7, holding portions 51, 52 for holding the fixing device 29 when the fixing device 29 is to be attached to the full-color printer body 1 are disposed in end portions in the longitudinal direction of the fixing device 29, respectively. In the fixing device 29, as shown in FIG. 3, the one holding portion 51 is configured by: a plate-like portion 53 which is horizontally projected from the housing 40 of the fixing device 29; and a step portion 54 which is disposed on the back face side of the fixing device 29 so as to be opposed to the plate-like portion 53. In the handle portion 52 of the housing 40 of the fixing device and configured by the plate-like portion 53 and the step portion 54, when the plate-like portion 53 is held by the tip end of the index finger and the step portion 54 is held by the tip end of the thumb, the holding portion can hold easily and surely the fixing device 29.

As shown in FIG. 3, also the other holding portion 52 of the fixing device 29 is configured similarly by: a plate-like portion 55 which is horizontally projected from the housing 40 of the fixing device 29; and a step portion 56 which is disposed on the back face side of the fixing device 29 so as to be opposed to the plate-like portion 55. When the plate-like portion 55 is held by the tip end of the index finger of the other hand and the step portion 56 is held by the tip end of the thumb of the other hand, the holding portion can hold easily and surely the fixing device 29.

Figure 1:
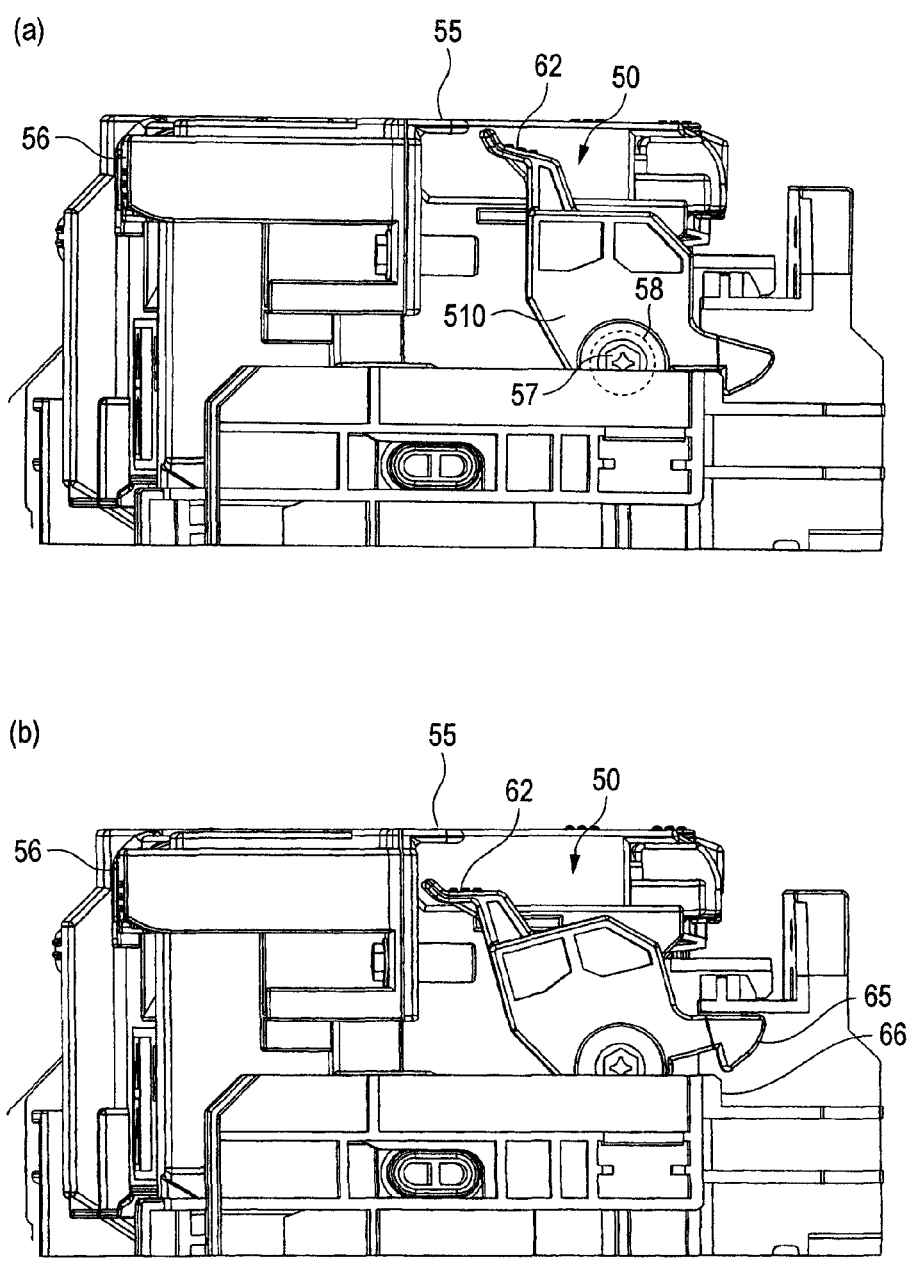
FIG. 1 is a front diagram showing main portions of a fixing device of Embodiment 1 of the invention.
Figure 9:
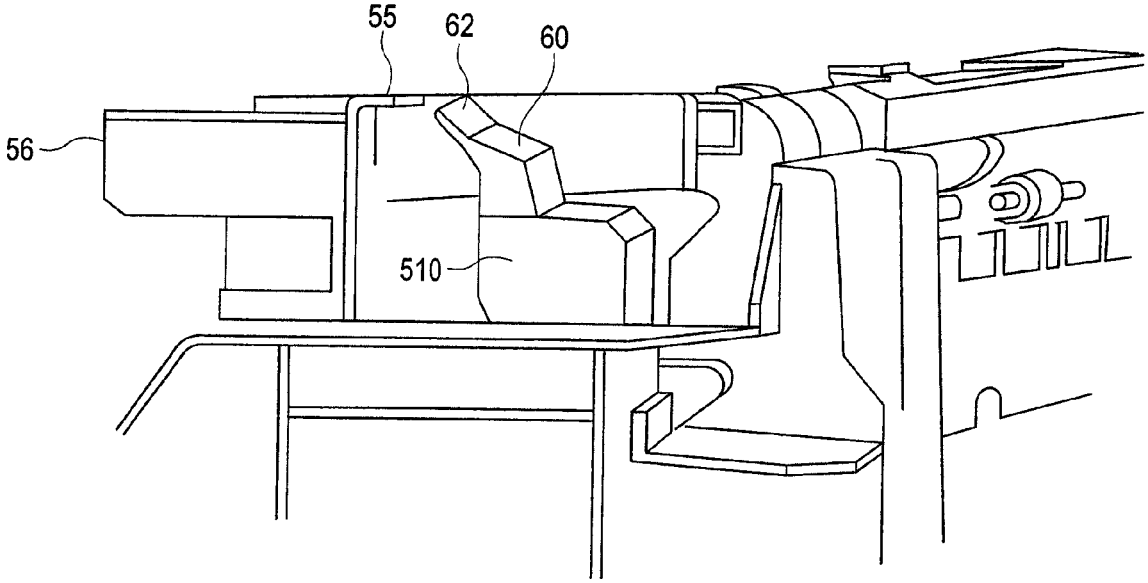
FIG. 9 is a perspective diagram showing an attachment state of the fixing device of Embodiment 1 of the invention.

As shown in FIGS. 1 and 9, the lock mechanism 50 for fixing the fixing device 29 to the full-color printer body 1 is disposed in the one end portions in the longitudinal direction of the fixing device 29. The lock mechanism 50 comprises a lock member 510. The lock member 510 is placed on the side of the front face of the holding portion 52 so that the member is substantially flush with the holding portion 52 on one end face of the fixing device 29 or on a flat plane as shown in FIG. 4(*a*). On one end face of the fixing device 29, as shown in FIG. 1, the lock member 510 is pivotally supported so as to be rotatable about a fulcrum 57, and attached in a state where it is urged in a clockwise direction by an urging member 58 such as a coil spring disposed in the outer periphery of the fulcrum 57.

Figure 10:
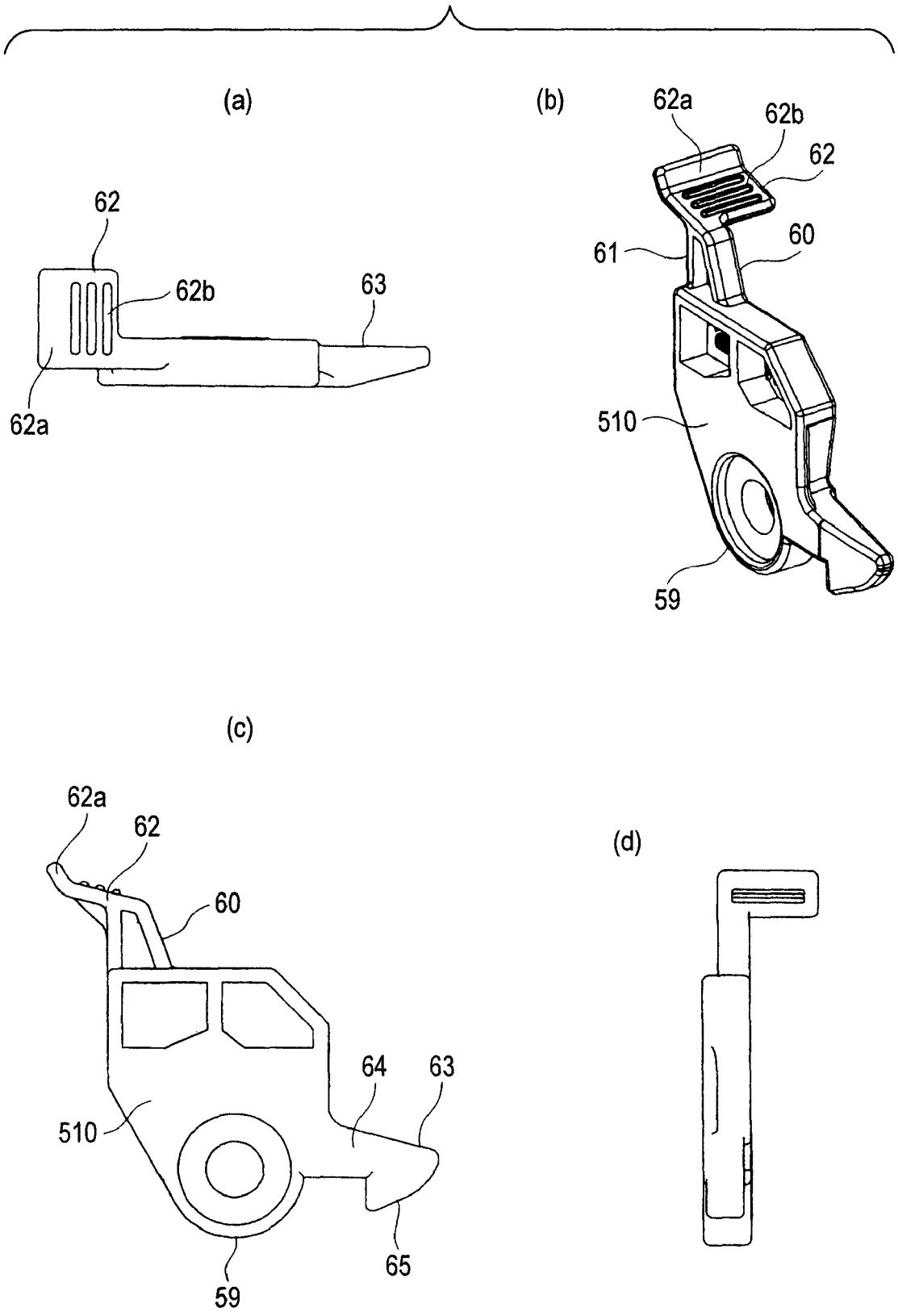
FIG. 10 is a view showing a lock member.

As shown in FIG. 10, the lock member 510 has a front shape which is formed into a slightly deformed polygonal shape. A semicircular shaft support portion 59 is disposed in a lower end portion of the member. In one end side of an upper end portion of the lock member 510, as shown in FIG. 10, an operating portion 60 for swingably operating the lock member 510 is disposed. The operating portion 60 comprises a basal end portion 61 which is projected from the upper end face of the lock member 510, and a finger-engaging portion 62 which is integrated with the basal end portion 61 in a state where the finger-engaging portion is inclined to the basal end portion. A tip end part 62*a* of the finger-engaging portion 62 is upward bent in order to allow the finger to be surely engaged with the portion. Plural non-slip projections 62*b* are disposed on the surface of the finger-engaging portion 62. The width of the finger-engaging portion 62 is set to be larger than that of the lock member 510 itself, so that the finger can be surely engaged with the portion.

In the lower end portion of the lock member 510, as shown in FIG. 10, a claw-like engaging portion 63 for fixing the fixing device 29 to the full-color printer body 1 is projected from the side face opposite to the operating portion 60. The engaging portion 63 is configured by a projected part 64 which horizontally extends, and a substantially triangular claw part 65 which is downward disposed on the tip end of the projected part 64.

Figure 11:
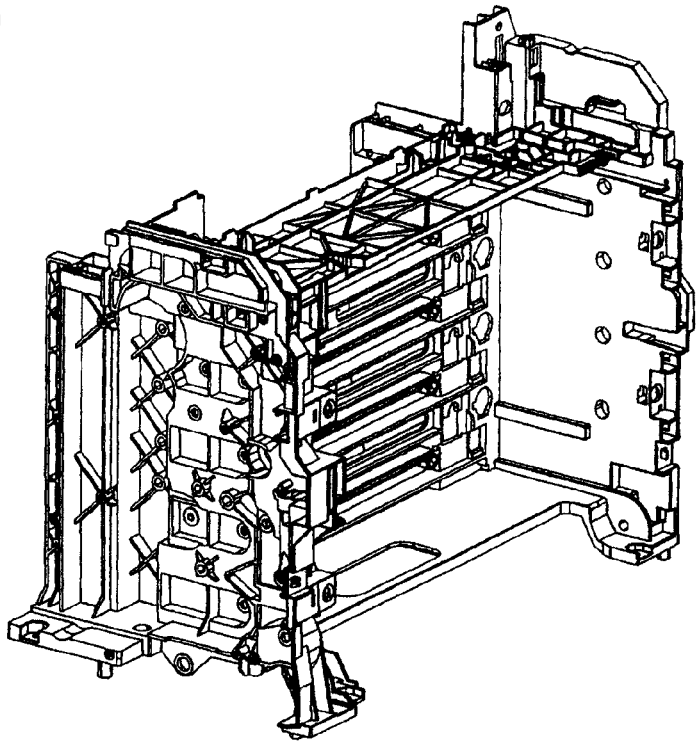
FIG. 11 is a perspective view of a frame showing a tandem full-color printer that is an image forming apparatus to which the fixing device of Embodiment 1 of the invention is applied.
Figure 11:
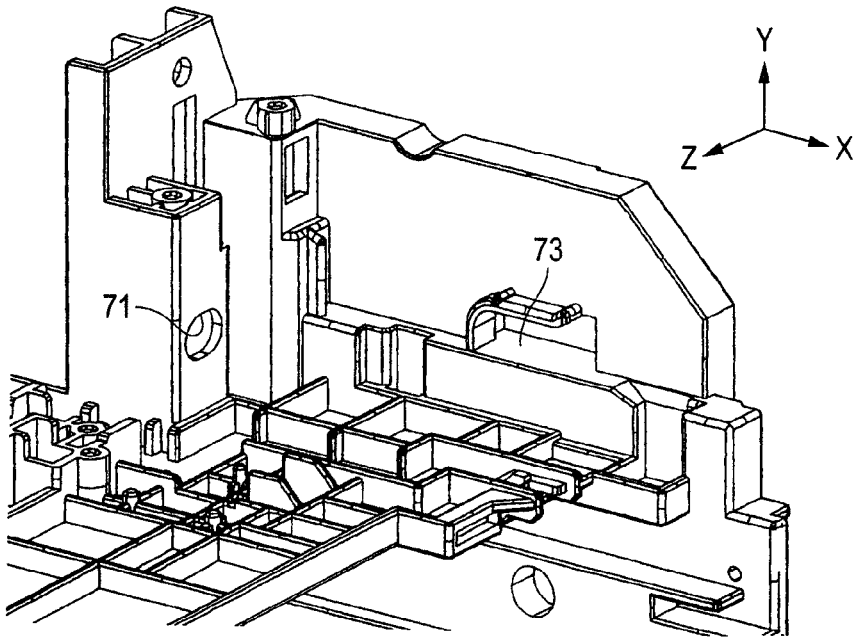
Figure 12:
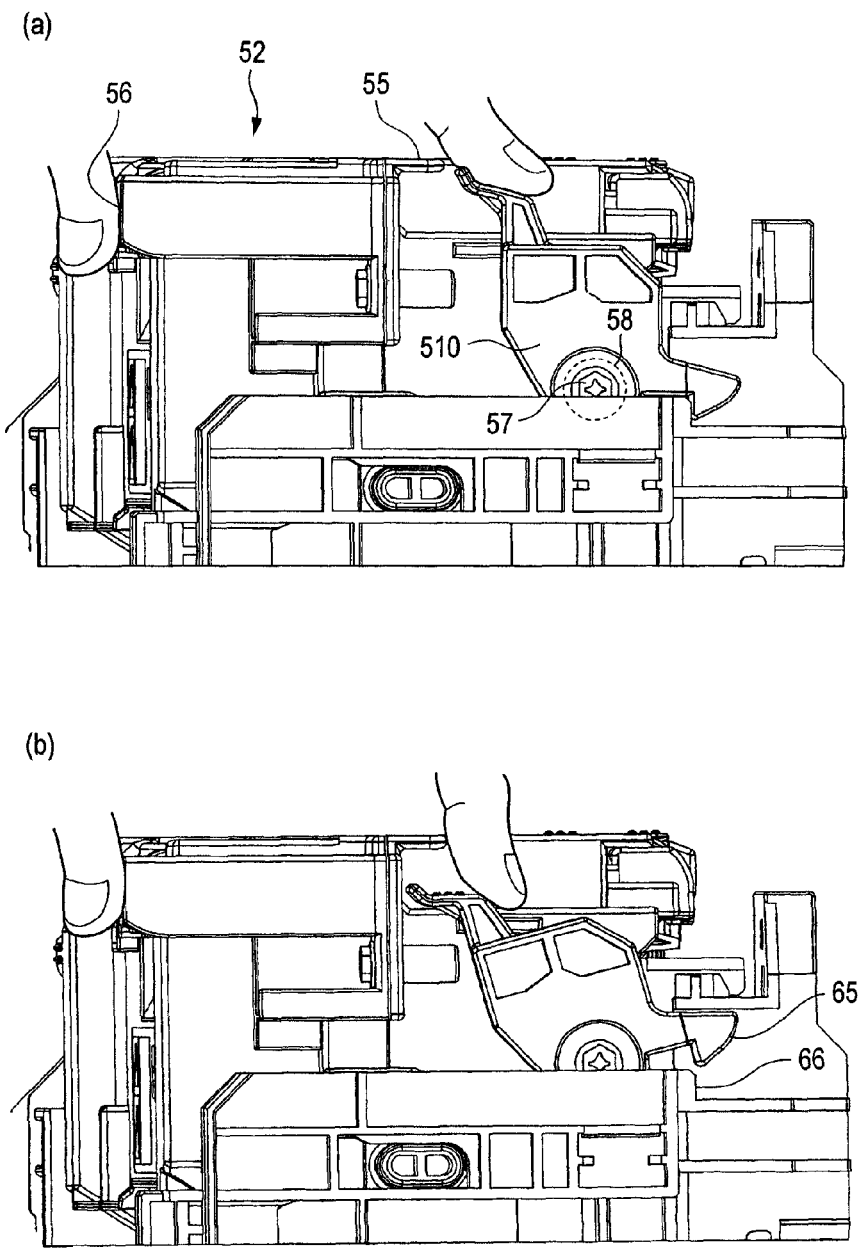
FIG. 12 is a diagram of an operation state showing main portions of a fixing device of Embodiment 1 of the invention.

When the operating portion 60 of the lock member 510 is operated as to swing in a counter clockwise direction as shown in FIG. 12, it is possible to cancel engagement between the claw-like engaging portion 63 and an engaging portion 66 configured by a step disposed at a predetermined position of the full-color printer body 1 as shown in FIG. 12. In the full-color printer body 1, as shown in FIG. 11, a hole 71 into which the engaging portion 63 of the lock member 510 is to be inserted is opened, and a height-restricting guide portion 73 which is to be fitted to a height-restricting projection 72 (see FIG. 15) which is disposed at a position opposite to the fixation side of the fixing device 29 is disposed.

As shown in FIG. 1(*a*), the finger-engaging portion 62 of the operating portion 60 of the lock member 510 is disposed in the front side of the flat plate-like holding portion 55 disposed in the fixing device 29, in close proximity to the holding portion 55, and at a substantially same as or slightly lower than the level of the holding portion 55.

The lock member 510 is configured so that, in the state where the tip end of the index finger of the right hand of the user is engaged with the finger-engaging portion 62 of the operating portion 60 as described above, and the tip end of the thumb of the right hand of the user is engaged with the step portion 56 which is disposed on the fixing device 29 so as to be opposed to the plate-like holding portion 55 as shown in FIG. 12, an operation of swinging the finger-engaging portion 62 of the operating portion 60 in a counter clockwise direction is performed by the tip end of the index finger of the right hand of the user.

In the operating portion 60 of the lock member 510, as shown in FIG. 12(*b*), the finger-engaging portion 62 then retracts below the flat plate-like holding portion 55 of the fixing device 29, thereby enabling the user to hold the flat plate-like holding portion 55 of the fixing device 29 by the tip end of the index finger of the right hand without changing the portion held by the hand or while maintaining the state.

By contrast, the one holding portion 51 of the fixing device 29 is configured so that operations of attaching and detaching the fixing device 29 to and from the full-color printer body 1 are performed in a state where the user holds the holding portion by the tip ends of the index finger and thumb of the left hand.

According to the configuration, in the fixing device of the embodiment, the operability of attachment and detachment of the fixing device can be improved in the following manner while avoiding the operation of holding the fixing device to become unstable by enabling the holding portion to be movable.

In the full-color printer, in a state where the thermal fixing device is attached to the full-color printer body 1 as shown in FIG. 2, the printing operation is performed, and a continuous use is enabled.

In the full-color printer, there is a case where the fixing device 29 is to be replaced with another device, such as the case where a component such as the heating roll 41 of the fixing device 29 is worn or degraded as result of a long-term use.

Figure 14:
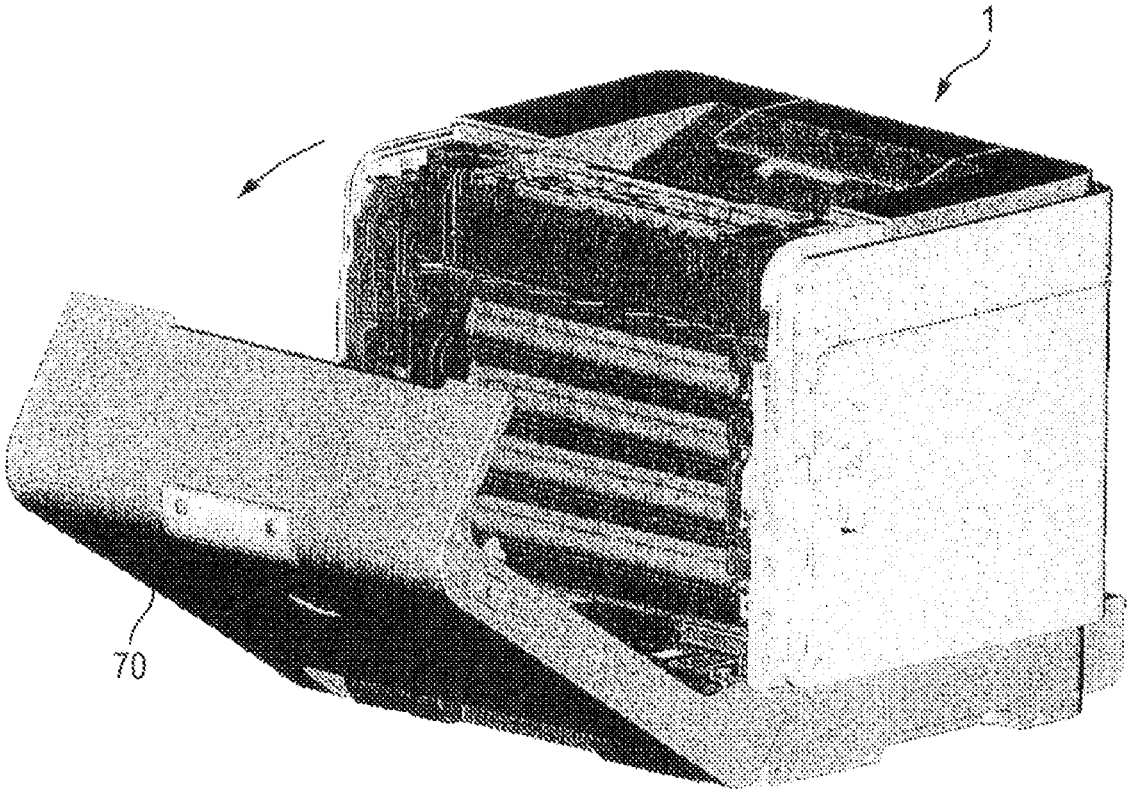
FIG. 14 is a perspective diagram showing operations of attaching and detaching the fixing device of Embodiment 1 of the invention.

In such a case, in the full-color printer body, a cover 70 which is disposed in front of the printer body 1 is opened in the direction of the arrow as shown in FIG. 14, and a state where the fixing device 29 which is integrally modularized is exposed is set. In this state, as shown in FIG. 3, the user holds by, for example, the tip ends of the index finger and thumb of the left hand, the holding portion 51 disposed in the one end portion of the fixing device 29 in the holding portions 51, 52 respectively disposed in the end portions of the fixing device.

By contrast, in order to cancel the lock state between the fixing device 29 and the full-color printer body 1, for example, the user engages the tip end of the thumb of the right hand with the step portion 56 constituting the holding portion 52 disposed in the one end portion of the fixing device 29, and engages the tip end of the index finger of the right hand with the finger-engaging portion 62 of the lock member 510 in the one end portion of the fixing device 29. In this state, as shown in FIG. 1, the finger-engaging portion 62 of the lock member 510 is rotationally moved (swung) in a counter clockwise direction.

Figure 15:
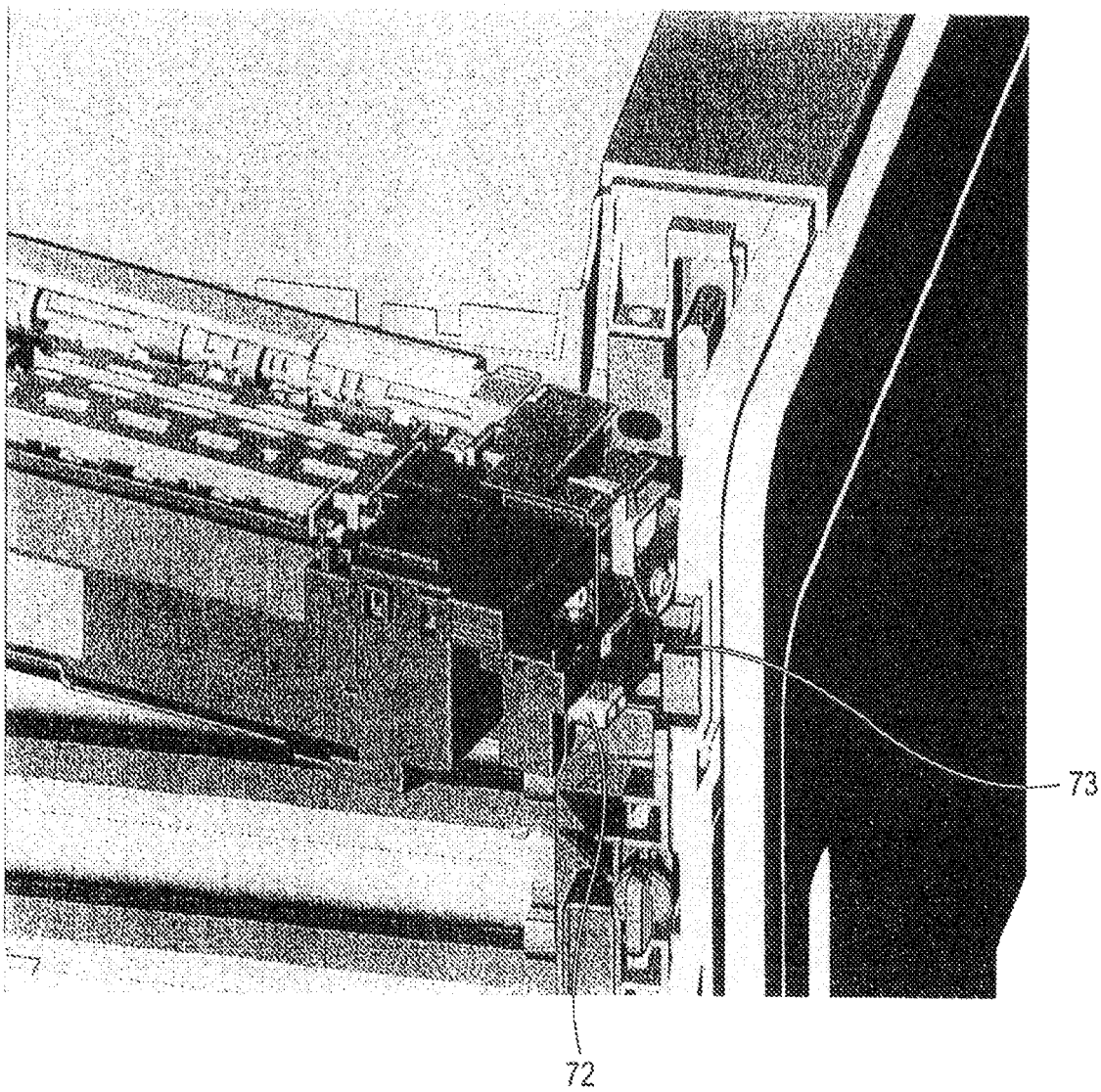
FIG. 15 is a perspective diagram showing operations of attaching and detaching the fixing device of Embodiment 1 of the invention.
Figure 16:
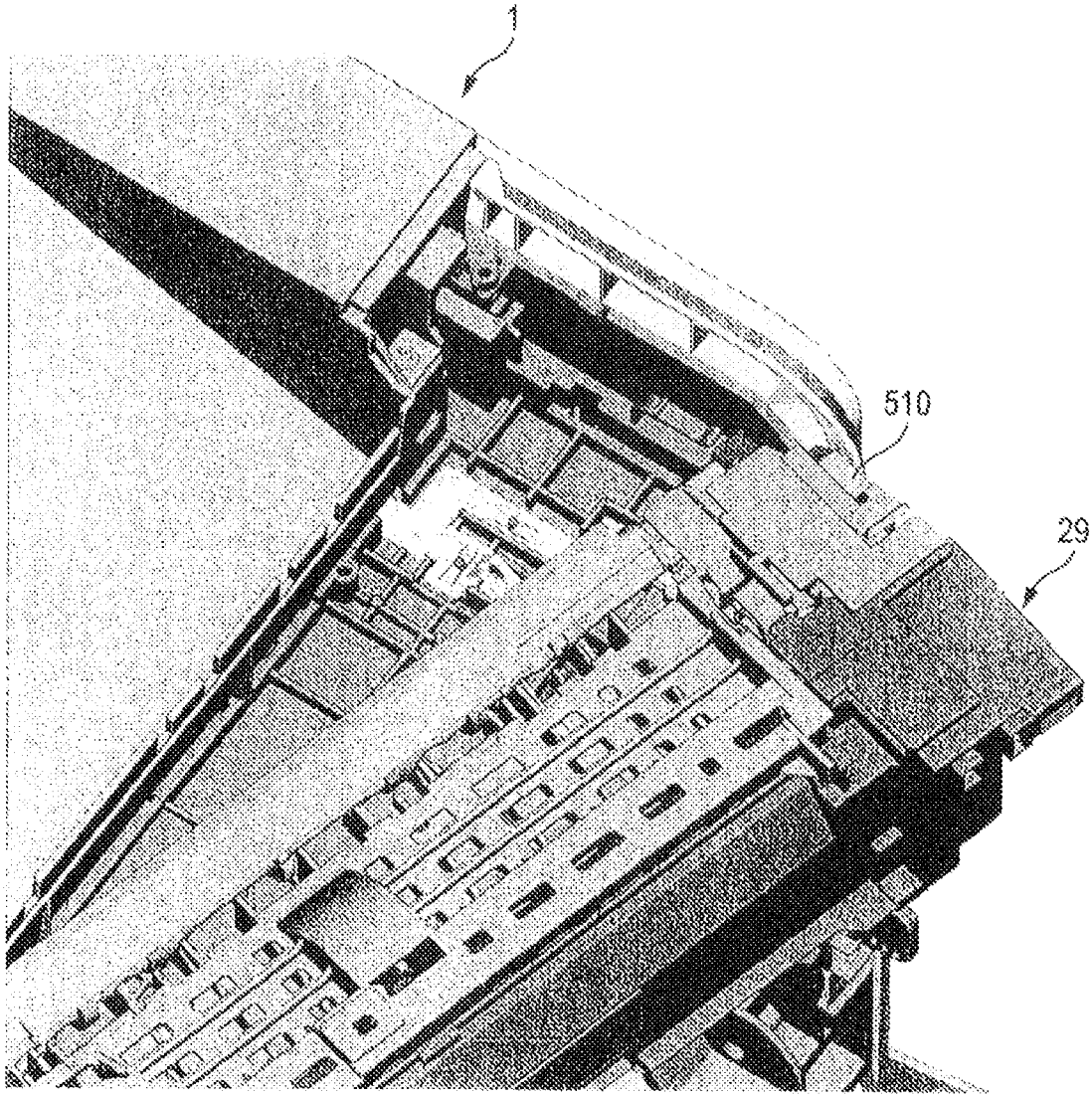
FIG. 16 is a perspective diagram showing operations of attaching and detaching the fixing device of Embodiment 1 of the invention.
Figure 17:
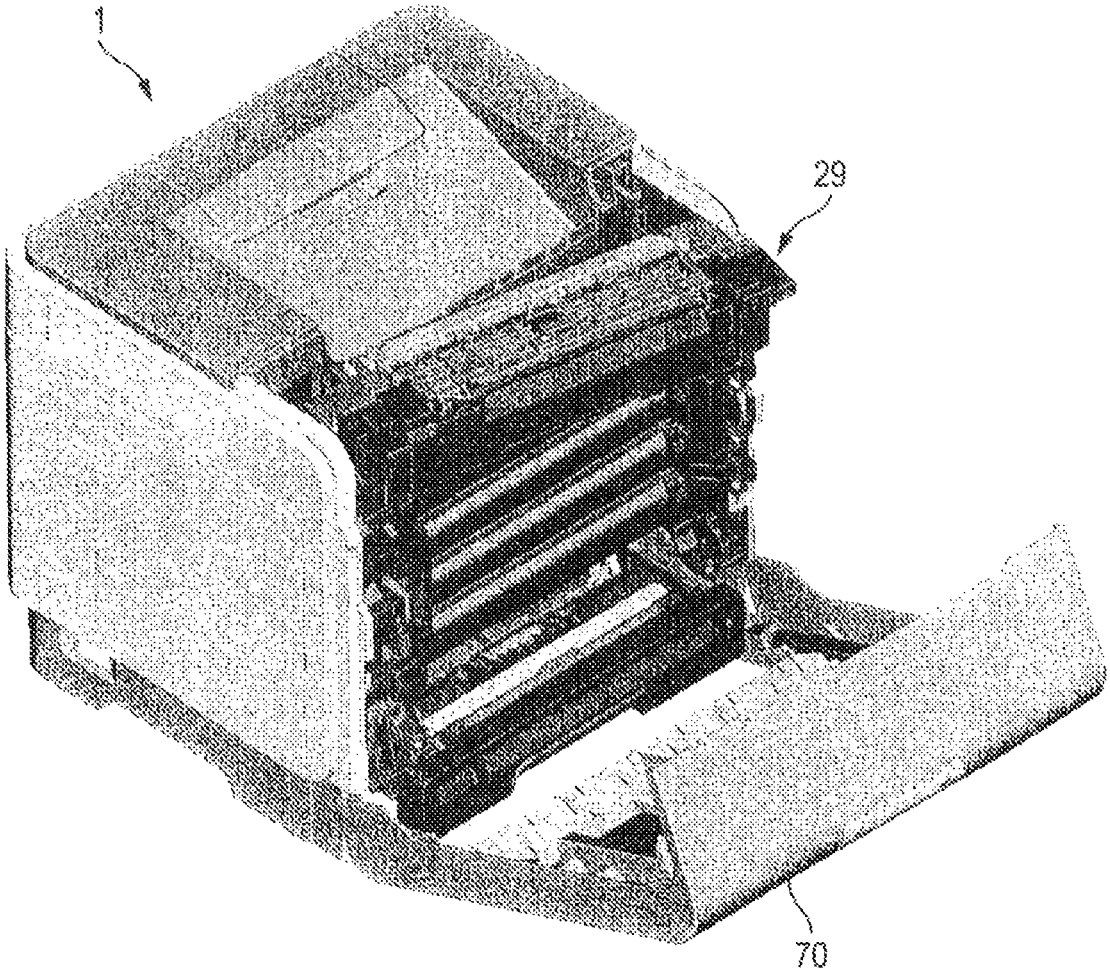
FIG. 17 is a perspective diagram showing operations of attaching and detaching the fixing device of Embodiment 1 of the invention.

Then, the engagement between the engagement portion 65 disposed on the lock member 510 and the engaging portion 66 disposed at the predetermined position of the full-color printer body 1 is cancelled, and a state where the fixing device 29 is detachable from the full-color printer body 1 is obtained as shown in FIGS. 15 to 17.

At this time, the user operates the tip end of the index finger of the right hand so as to swing the finger-engaging portion 62 of the operating portion 60 of the lock member 510 in a counter clockwise direction. Because the holding portion is positioned outside the radius of rotation of the operating portion 60, in the operating portion 60 of the lock member 510, as shown in FIG. 1, the finger-engaging portion 62 is moved to retract inside or namely below the projection end portion of the flat plate-like holding portion 55 projected from the housing of the fixing device 29. Therefore, the user can hold the flat plate-like holding portion 55 of the fixing device 29 by the tip end of the index finger of the right hand without changing the portion held by the hand or while maintaining the state. Namely, attachment and detachment of the fixing device 29 can be performed by the single operation (one action) of holding the operating portion 60.

Figure 18:
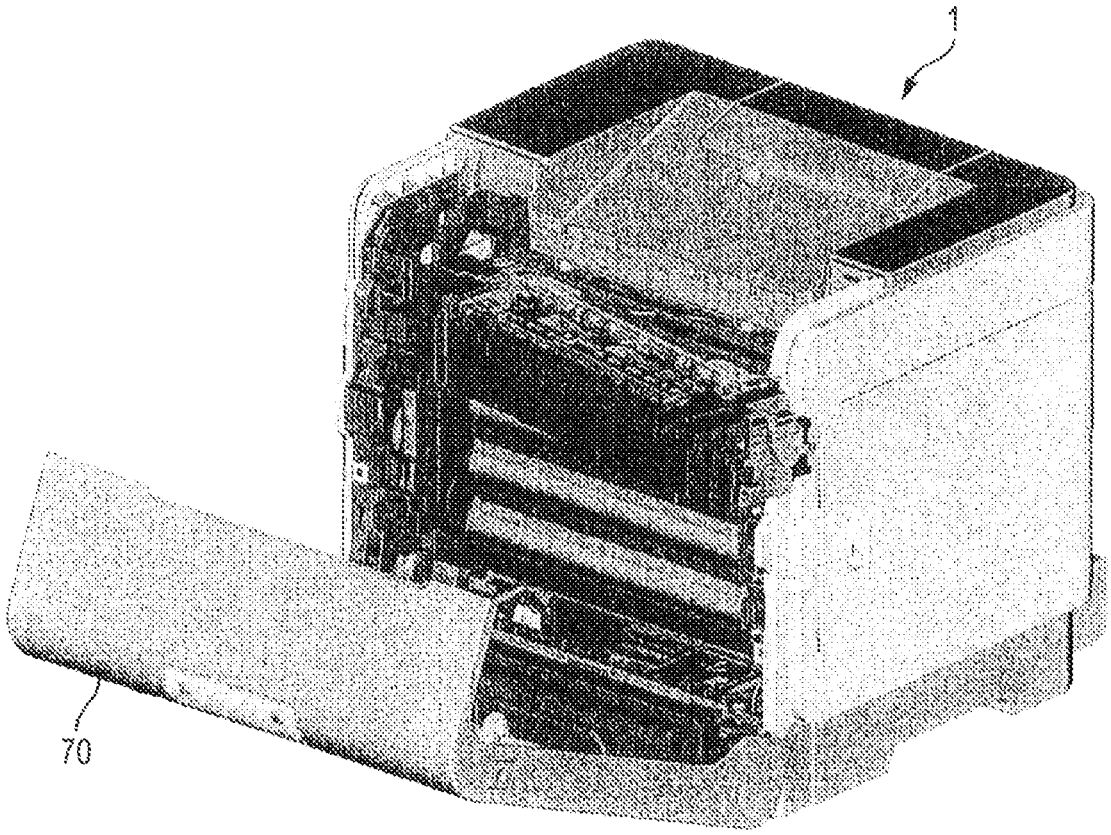
FIG. 18 is a perspective diagram showing operations of attaching and detaching the fixing device of Embodiment 1 of the invention.
Figure 19:
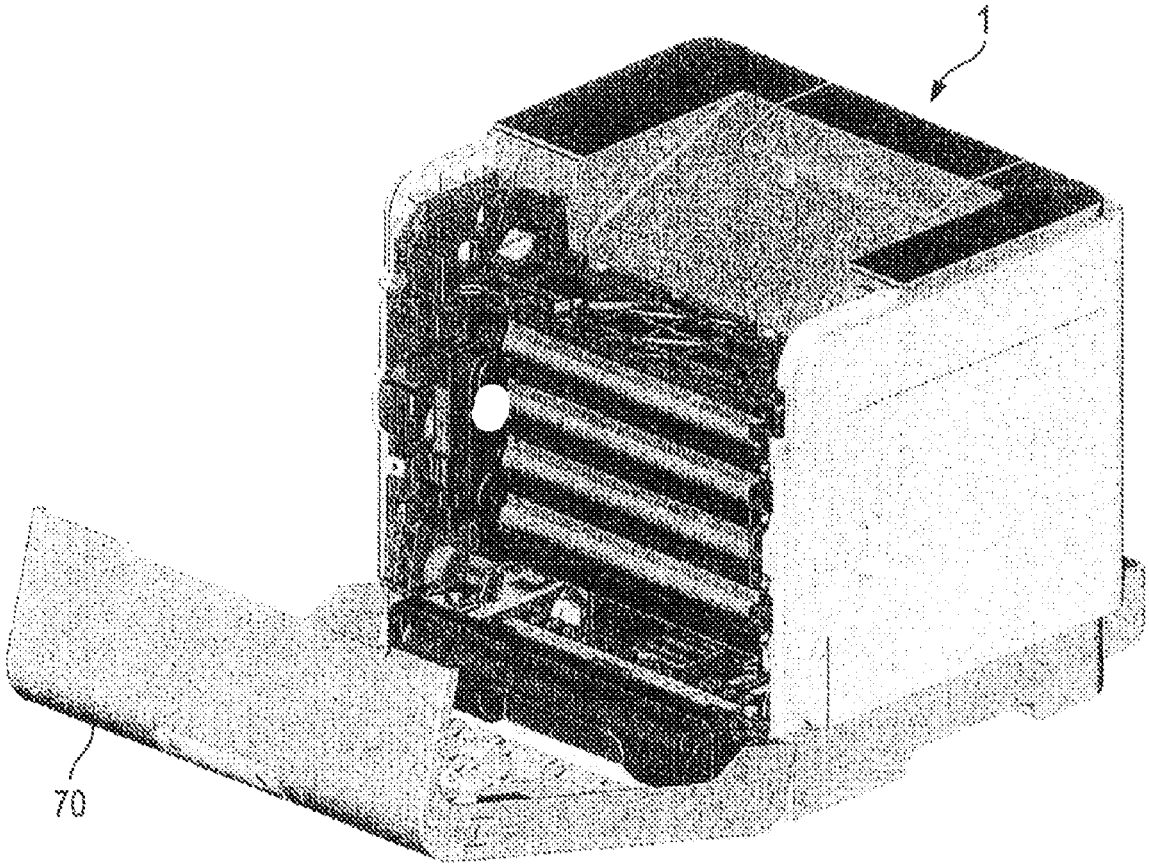
FIG. 19 is a perspective diagram showing operations of attaching and detaching the fixing device of Embodiment 1 of the invention, wherein 1 denotes printer body, 29 denotes fixing device (unit), 50 denotes lock mechanism, 510 denotes lock member, 51 and 52 denote holding portion, 55 denotes flat plate-like holding portion, 60 denotes operating portion, 62 denotes finger-engaging portion, 65 denotes claw part, and 66 denotes engaging portion.

In the state where the portion held by the hand is not changed and the fixing device 29 is directly held, as shown in FIGS. 18 and 19, the user cancels the engagement state between the rods 44, 45 of the fixing device 29 and the frame 46 of the printer body 1 while rearward sliding the side where the lock member 510 of the fixing device 29 is disposed, whereby the fixing device 29 can be easily detached from the printer body 1. When the fixing device 29 is to be attached to the printer body 1, operations may be performed in the sequence opposite to the above.

Figure 13:
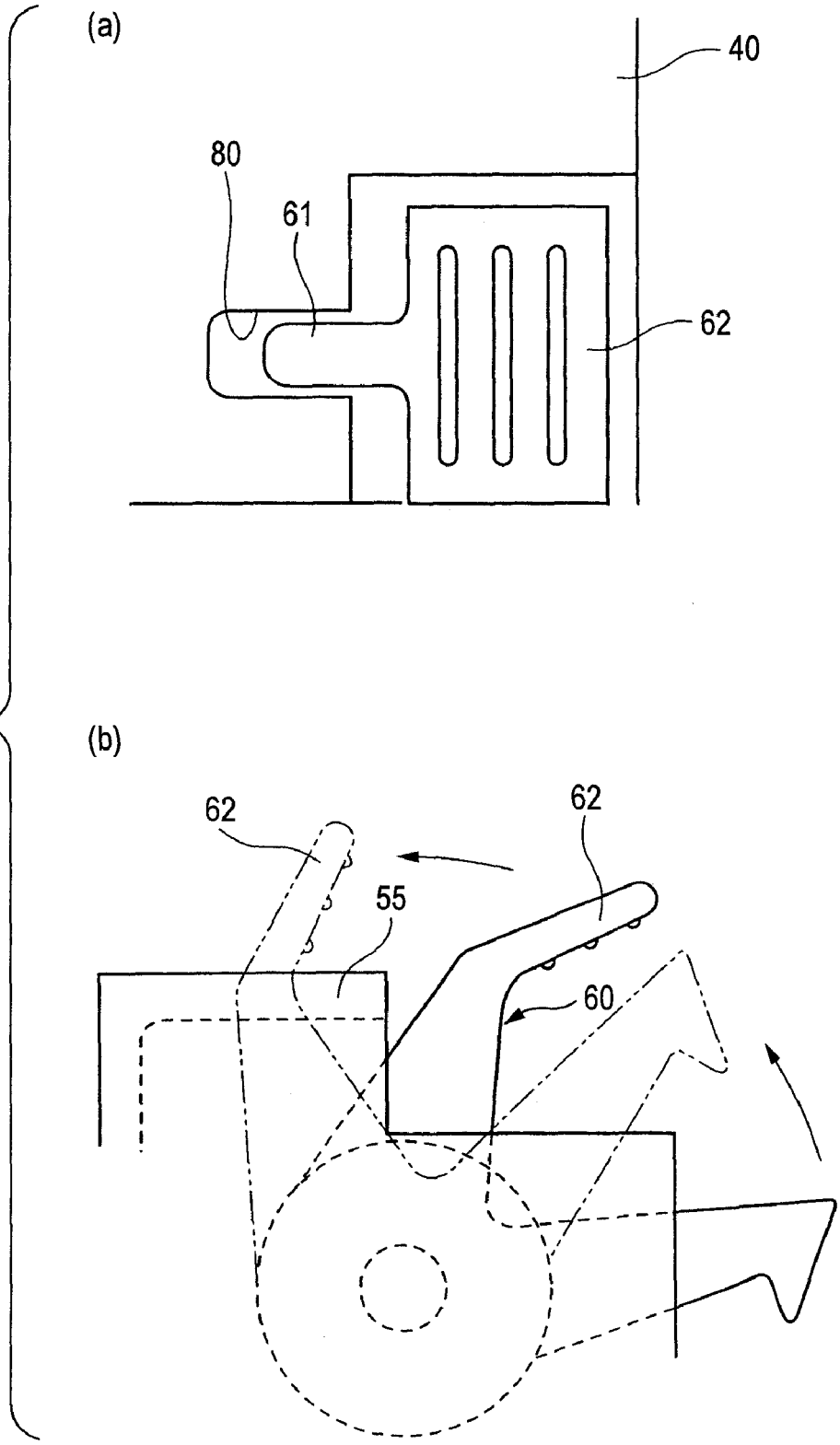
FIG. 13 is a diagram showing main portions of a fixing device of another embodiment of the invention.

FIG. 13 shows another embodiment of the invention. A description will be made while identical components as the above-described embodiment are denoted by the same reference numerals. In this embodiment, the operating portion 60 of the lock mechanism 50 is placed above the holding portion 55, so that the lock mechanism 50 of the fixing device 29 can be recognized in one glance.

As shown in FIG. 13, the user causes the operating portion 60 of the lock mechanism 50 to be swung by the tip end of the index finger, thereby canceling the lock state. The operating portion 60 of the lock mechanism 50 retracts more than the holding portion 55, and hence is configured so as to be swung along a cutaway 80 disposed in the holding portion 55.

Although the embodiments in which a fixing device is used as the unit have been described in detail, the invention is not particularly restricted to them. The invention can be applied to any unit as far as it is configured to be attachable to and detachable from an apparatus body. An example of the unit is a unit of an image forming apparatus, the unit having at least one of an image carrier, a developer carrier, a developer, a charging unit, and a cleaning unit. When the developing device 11 is configured so as to be replaceable, for example, the developing device may have a holding portion and a lock mechanism. The invention may be applied also to a so-called process cartridge in which a developing device, a photosensitive drum, a cleaning device, and the like are integrally configured. Alternatively, the invention may be applied also to a toner cartridge which houses only a toner.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A fixing unit which is configured to be attachable to and detachable from a body of an image forming apparatus, wherein said fixing unit comprises:

a holding portion disposed at a distal end portion of said fixing unit for holding said fixing unit to attach and detach said fixing unit to and from said apparatus body, said holding portion comprising a plate portion that projects from the holding portion at a first distal end of the holding portion; and a lock mechanism for fixing said unit to said apparatus body, said lock mechanism rotatable at a radius of rotation that extends in close proximity to the plate portion, wherein an operating portion of said lock mechanism retracts inside a projection end of said plate portion of said holding portion that projects from the holding portion by an operation of rotating said lock mechanism to a lock cancel position.

2. The unit according to claim 1, wherein said holding portion is positioned outside the radius of rotation of said operating portion.

3. The unit according to claim 1, wherein said holding portion is disposed in a plurality of distal end portions of said fixing unit in a longitudinal direction of said fixing unit.

4. The unit according to claim 1, wherein said operating portion of said lock mechanism is placed above said holding portion.

5. The unit according to claim 1, wherein said operating portion of said lock mechanism is placed at a same level as said holding portion or below said holding portion.

6. The unit according to claim 1, wherein an operating direction of said operating portion of said lock mechanism is substantially identical with a direction which said fixing unit is moved while being detached.

7. An image forming apparatus comprising the unit according to claim 1, wherein said fixing unit comprises a heating member, and said lock mechanism fixes said image forming apparatus with said fixing device.

8. The unit according to claim 1, wherein the lock mechanism comprises an engaging portion which is configured to engage the apparatus body to fix said fixing unit to said apparatus body, wherein the engaging portion and the operating portion are provided on opposite ends of the lock mechanism respectively, and wherein the engaging portion and the operating portion are rotated about a common axis in response to the lock mechanism being moved from a lock position to the lock cancel position.

9. The unit according to claim 1, wherein the operating portion of said lock mechanism retracts inside a space provided between the projection end portion of said plate portion and another portion of said fixing unit by the operation of rotating said lock mechanism to the lock cancel position.

10. A fixing unit which is configured to be attachable to and detachable from a body of an image forming apparatus, wherein said fixing unit comprises:

a holding portion disposed at a distal end portion of said fixing unit for holding said fixing unit to attach and detach said fixing unit to and from said apparatus body, said holding portion comprising a plate portion that projects from the holding portion at a first distal end of the holding portion; and a lock mechanism for fixing said unit to said apparatus body, said lock mechanism rotatable at a radius of rotation that extends in close proximity to the plate portion, wherein the lock mechanism is configured such that rotating an operating portion of said lock mechanism to a lock cancel position towards the plate portion of the holding portion by a hand of a user causes said holding portion to be held directly by the hand.

11. The unit according to claim 10, wherein said holding portion is disposed in a plurality of distal end portions of said fixing unit in a longitudinal direction of said fixing unit.

12. The unit according to claim 10, wherein said operating portion of said lock mechanism is placed above said holding portion.

13. The unit according to claim 10, wherein said operating portion of said lock mechanism is placed at a same level as said holding portion or below said holding portion.

14. The unit according to claim 10, wherein an operating direction of said operating portion of said lock mechanism is substantially identical with a direction which said fixing unit is moved while being detached.

15. An image forming apparatus comprising the unit according to claim 10, wherein said fixing unit comprises a heating member, and said lock mechanism fixes said image forming apparatus with said fixing device.

16. The unit according to claim 10, wherein the lock mechanism comprises an engaging portion which is configured to engage the apparatus body to fix said fixing unit to said apparatus body, wherein the engaging portion and the operating portion are provided on opposite ends of the lock mechanism respectively, and wherein the engaging portion and the operating portion are rotated about a common axis in response to the lock mechanism being moved from a lock position to the lock cancel position.

* * * * *